United States Patent [19]

Jacobs

[11] Patent Number: 4,768,654

[45] Date of Patent: Sep. 6, 1988

[54] BAG WITH POUR SPOUT FEATURE

[75] Inventor: Richard W. Jacobs, Eden Prairie, Minn.

[73] Assignee: Bemis Company, Inc., Minneapolis, Minn.

[21] Appl. No.: 359,420

[22] Filed: Mar. 18, 1982

[51] Int. Cl.[4] ..... B43M 7/00

[52] U.S. Cl. ..... 206/626; 206/622

[58] Field of Search ..... 206/626, 634, 607, 618, 206/621, 622, 624, 610, 628, 601; 150/8, 9; 229/17 B, 17 R, 55; 383/120

[56] References Cited

U.S. PATENT DOCUMENTS 2,820,585 1/1958 Nerenberg et al. ..... 229/17 R 3,002,674 10/1961 Wright ..... 206/607 X 3,415,440 12/1968 Watters ..... 229/55

*Primary Examiner*—Henry J. Recla

*Assistant Examiner*—David Voorhees

*Attorney, Agent, or Firm*—Senniger, Powers, Leavitt and Roedel

[57] ABSTRACT

A multi-ply gusseted bag having a set of lines of perforations in one of its gussets extending across the gusset adjacent one end of the bag such that, as regards the filled and closed bag, the portion of the gusset between the set of lines of perforations and said one end of the bag may be pushed in and separated from the remainder of said one gusset by tearing on said set of lines of perforations, and may then be pulled out to form a pouring spout.

3 Claims, 2 Drawing Sheets

BAG WITH POUR SPOUT FEATURE

BACKGROUND OF THE INVENTION

This invention relates to bags, and more particularly to a bag with a pouring spout feature.

The invention is especially concerned with a pour spout feature for multiwall pinch bottom bags, i.e., openmouthed multiwall bags which have a pinch bottom formed in the course of the manufacture of the bags and a formation at the mouth end adapted to be formed into a pinch closure after the bag has been filled through its mouth. It is to be understood, however, that the pour spout feature of this invention may be just as readily incorporated in other types of bags, including sewn open mouth bags, sewn valve bags, pasted open mouth bags and pasted valve bags.

SUMMARY OF THE INVENTION

Among the several objects of this invention may be noted the provision of a bag with an improved pour spout feature, the spout being provided as an integral part of the bag in an efficient and economical manner, and being easy to open and convenient to use; the provision of a bag adapted for easy opening and manipulation of part of the bag to form a pour spout at one corner of the bag; and the provision of such a pour spout feature for multiwall bags, and particularly gusseted multiwall bags, such as pinch bottom bags, sewn or pasted open mouth bags, and sewn or pasted valve bags.

Generally the invention is incorporated in a bag which has front, back and side walls, each side wall joining the front wall at a front fold and the back wall at a back fold, these folds extending longitudinally of the bag and constituting side folds of the bag. One of the side walls has a line of weakness extending across it generally from the respective front fold to the respective back fold. With respect to the bag as filled and closed, the portion of the said one side wall between said line of weakness and the said one end of the bag may be pushed in and separated from the remainder of said one side wall by tearing on the line of weakness, and said portion may then be pulled out to form a pouring spout.

Other objects and features will be in part apparent and in part pointed out hereinafter.

BRIEF DESCRIPTION OF THE DRAWINGS

Corresponding reference characters indicate corresponding parts throughout the several views of the drawings.

DESCRIPTION OF THE PREFERRED EMBODIMENT

Figure 1:
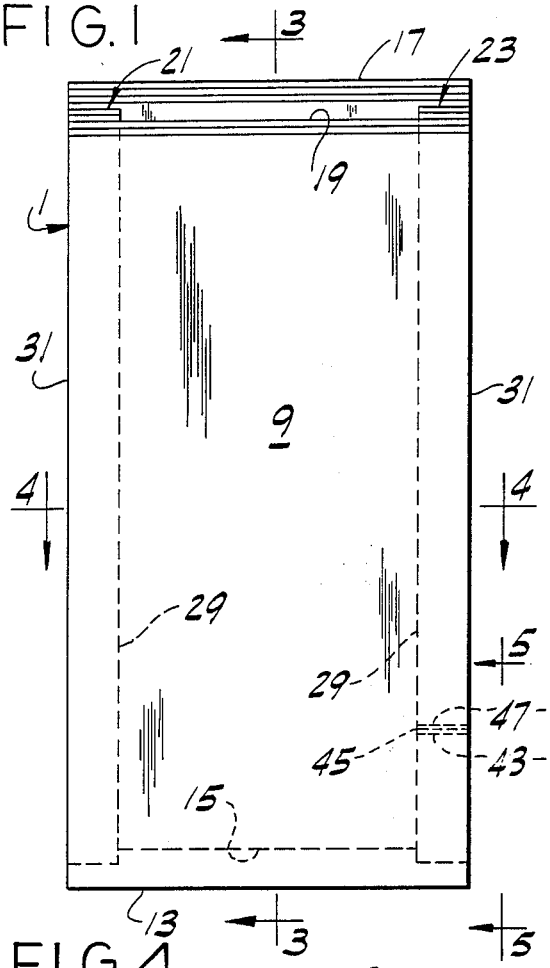
FIG. 1 is a front elevation of a gusseted bag tube which is to be formed into a pinch bottom bag incorporating the pour spout feature of this invention.
Figure 2:
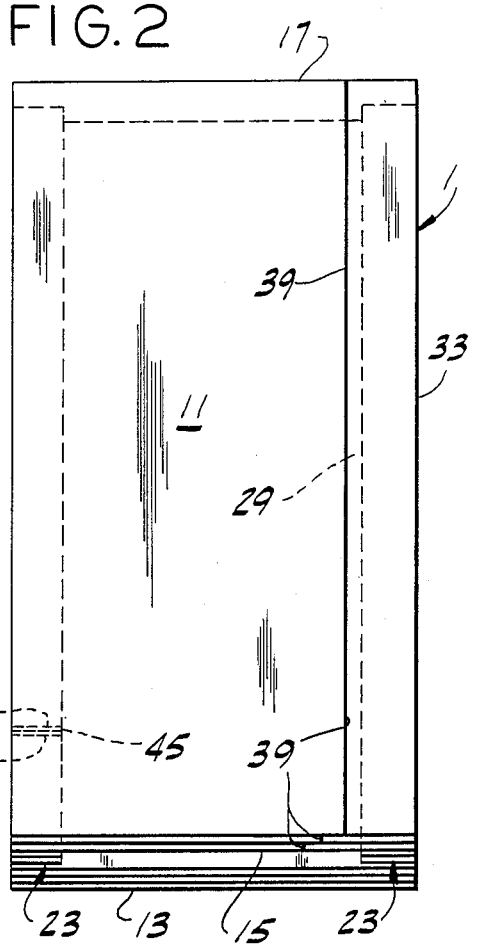
FIG. 2 is a rear elevation of the bag tube.
Figure 4:
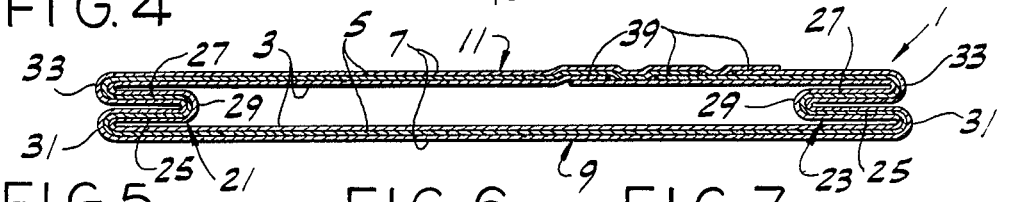
FIG. 4 is a transverse (horizontal) section on line 4—4 of FIG. 1, with thicknesses exaggerated.

Referring to the drawings, first more particularly to FIGS. 1–4, there is indicated at 1 a gusseted multi-ply paper bag tube made generally in well-known manner (well-known except for the spout feature to be described) for the formation of pinch-type closures at each of its ends. As herein illustrated, the bag tube 1 is a three-ply tube, the inner of the three plies being designated 3, the intermediate ply being designated 5, and the outer ply being designated 7. One wall of the tube, which may be arbitrarily referred to as the front wall, is designated 9 and the opposite or back wall is designated 11. For the formation of pinch-type closures at the ends of the tube, the front wall 9 has an extension 13 at one end of the tube (its lower end as illustrated) projecting beyond the respective edge 15 of the back wall 11, and the back wall 11 has a complementary extension 17 at the other (upper) end projecting beyond the respective edge 19 of the front wall 9.

Figure 5:
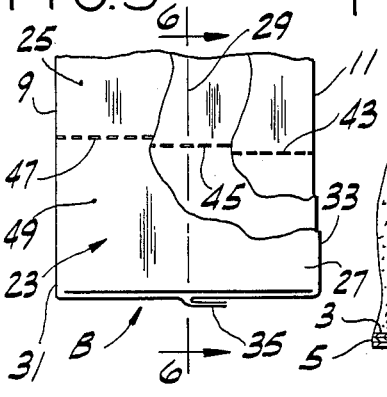
FIG. 5 is a view taken generally on line 5—5 of FIG. 1, with plies broken away, showing the FIG. 1 bag tube formed with a pinch bottom, showing the bag as it appears when filled with the front and back walls spread apart and the gusset at the right side of FIG. 1 spread generally flat, and showing certain lines of perforations in the plies.
Figure 6:
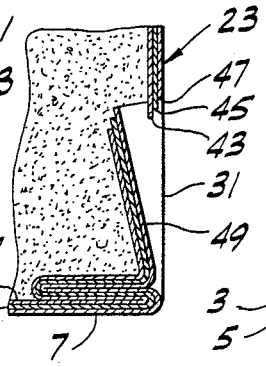
FIG. 6 is a vertical section generally on line 6—6 of FIG. 5, on a somewhat larger scale than FIG. 5, showing the portion of the right side gusset between the lines of perforations and the bottom of the bag pushed in and separated from the remainder of this gusset by tearing on the lines of weakness.
Figure 7:
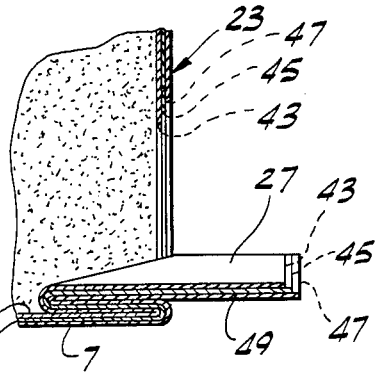
FIG. 7 is a view similar to FIG. 6 showing said portion pulled out to form the pouring spout.
Figure 3:
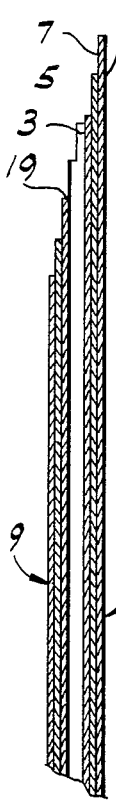
FIG. 3 is a longitudinal (vertical) section on line 3—3 of FIG. 1, with thicknesses exaggerated and parts broken away.

The gussets of the bag tube 1 are generally designated 21 and 23. Each gusset comprises two halves or panels 25 and 27, 25 being referred to as the front panel and 27 as the back panel, integrally joined on a center fold or crease 29, the front panel 25 being joined to the front wall 9 at a front fold or crease 31 and the back panel 27 being joined to the back wall 11 at a back fold or crease 33, all these folds extending longitudinally (heightwise) of the bag tube. The plies may be stepped in the front and back walls and in the gussets, accounting for the showing of the stepped ends of the walls and gussets in FIGS. 1–3 and 8, but since this is conventional and not at all critical insofar as this invention is concerned, the stepping will not be described in detail. The extension 13 of wall 9 at the bottom of the bag tube is adapted to be folded over on the outside of wall 11 and adhered to wall 11 in suitable manner to form a bottom pinch-type closure 35 for the bag B (FIGS. 5 and 8) made from the tube 1, this bottom end closure being pre-formed at the bag factory. After the bag has been filled, the extension 17 of the wall 11 at the top of the bag is adapted to be folded over on the outside of wall 9 and adhered to wall 9 in suitable well-known manner to form a top pinch-type closure 37 (FIG. 9) for the bag.

Bag tubes 1 are generally made in conventional and well known manner by perforating and bringing together three webs of paper in a tuber, (the webs being perforated in accordance with the desired step pattern) forming the resultant three ply web into tubing in the tuber with longitudinal seams for the plies; and then segmenting the individual tubes 1 from the tubing. The longitudinal ply seams appear in FIG. 4 at 39. The gussets form what may be termed side walls, one left, one right.

Figure 8:
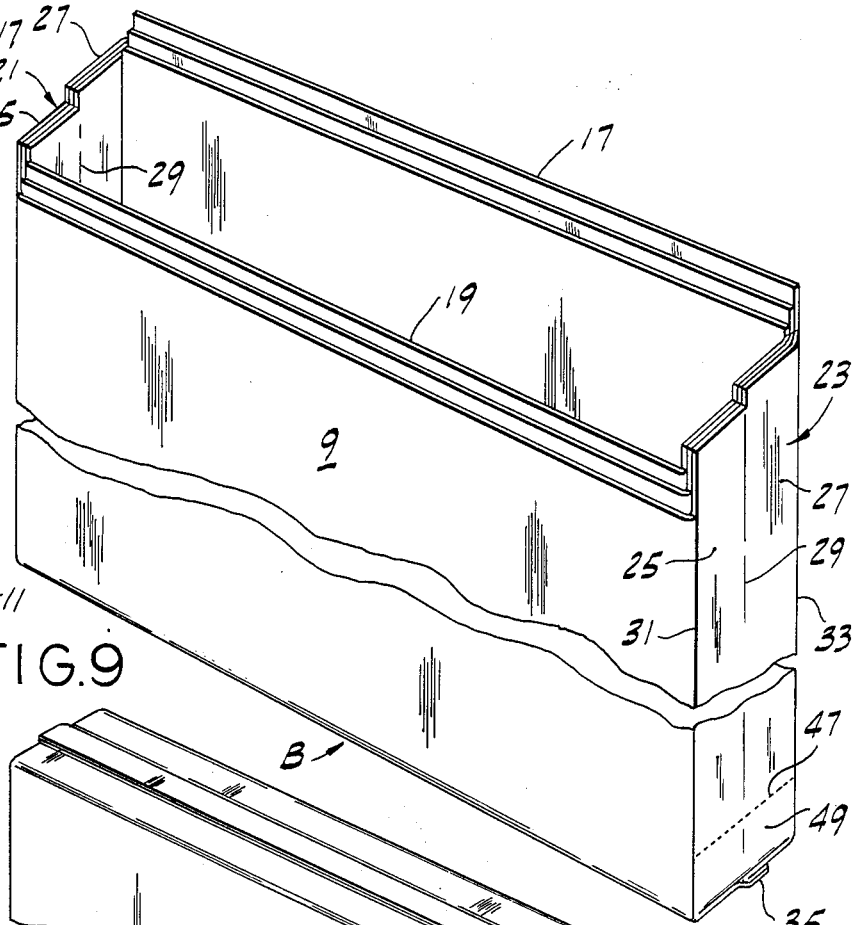
FIG. 8 is a view generally in perspective of a completed pinch bottom bag as it appears when filled but before its upper end is closed.

In accordance with this invention, each of the three plies 3, 5 and 7 of the bag tube 1 or bag B is provided with a line of weakness, and more particularly a line of perforations, extending across one of the gussets, more particularly the right-hand gusset 23 as viewed in FIG. 8, from the respective front fold 31 to the respective back fold 33 adjacent one end of the bag, more particularly its bottom end.

The lines of perforations in the inner ply 3, the intermediate ply 5 and the outer ply 7 are respectively designated 43, 45 and 47. These lines are offset or stepped longitudinally of the bag, 45 being stepped up from 43, and 47 being stepped up from 45. All these lines of perforations, including 43, are spaced from a distance somewhat greater than the gusset panel width, i.e. half the full width of the gusset as unfolded or expanded to form the side walls for the bag. The purpose of the offset or stepping of the lines of perforation is to provide security against sifting of the contents of the bag out of the bag, especially in the case where the bag is filled with particulate material.

Figure 9:
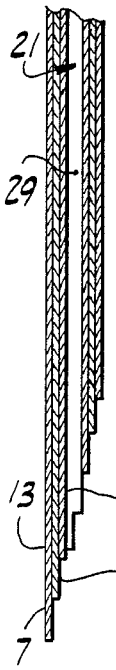
FIG. 9 is a view similar to FIG. 8 showing the filled bag closed, and the pour spout opened up for pouring out the contents of the bag.
Figure 9:
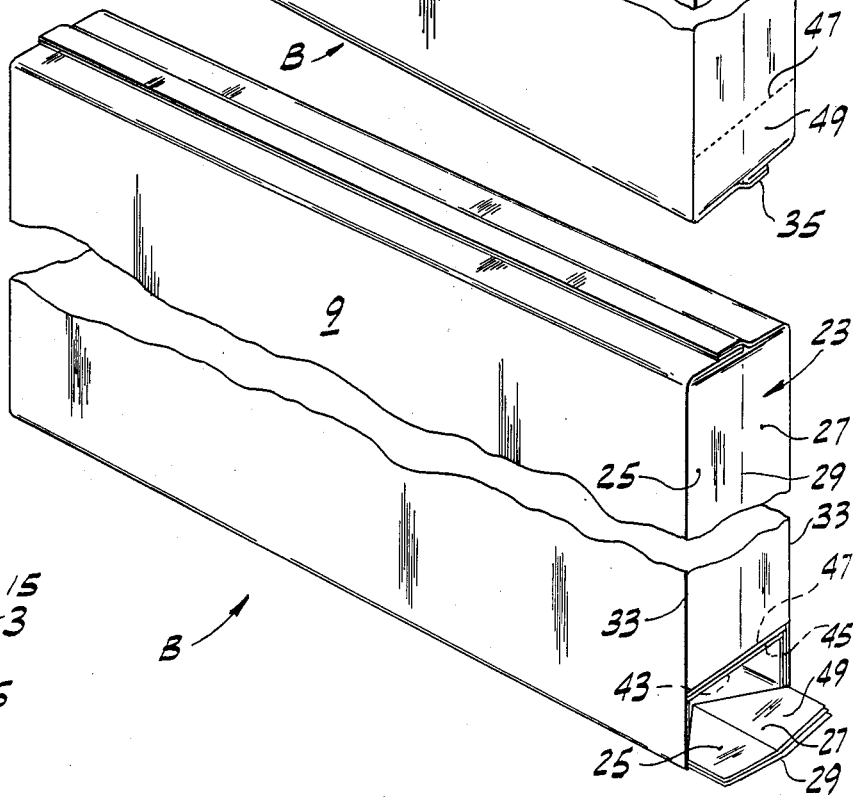

With respect to the bag B as filled and closed (FIG. 9), the lines of perforations 43, 45 and 47 enable the portion 49 of the gusset or side wall 23 between the lines of perforations and the bottom end of the bag to be pushed in and separated from the remainder of the gusset (above the lines of perforations) by tearing all three plies 3, 5 and 7 on the lines of perforations. It will be understood that when the bag is filled, e.g. with particulate material, the front and back walls 9 and 11 spread apart, the gussets 21 and 23 spread out (and may bulge out slightly), and the bottom generally flattens out. As portion 49 of the spread-out gusset 23 is pushed in and separates, its two halves (the segments of gusset panels 25 and 27 in portion 49) fold in on the center fold line 29 of the gusset. Portion 49 as so separated at the lines of perforations may then be pulled outwardly and downwardly to form a pouring spout, being further separated by tearing it away along the portions of the front and back fold or crease lines 31 and 33 extending from the ends of the lines of perforations down to the bottom of the bag as illustrated in FIG. 9. The fold or crease lines 31 and 33 act as tear lines for the purpose of tearing portion 49 away as described. The segments of gusset panels 25 and 27 in portion 49 fold up on line 29 to form the spout. The lines of perforations are spaced from the bottom of the bag a distance selected to make the spout of adequate size for ready pouring of the bag contents.

While the bag is above described as a multiwall pinch bottom bag consisting of three paper plies, it will be understood that the invention is applicable to a bag with more or fewer plies, and to a bag having a barrier ply or plies of plastic film (e.g. polyethylene film) as well as structural plies of paper. Generally, all structural plies will have the spout-forming lines of perforations therein, but the barrier ply or plies will not. It will also be readily understood that the invention is applicable to bags other than pinch bottom bags, e.g., sewn or pasted open mouth bags and sewn or pasted valve bags.

In view of the above, it will be seen that the several objects of the invention are achieved and other advantageous results attained.

As various changes could be made in the above constructions without departing from the scope of the invention, it is intended that all matter contained in the above description or shown in the accompanying drawings shall be interpretted as illustrative and not in a limiting sense.

What is claimed is:

1. A multi-ply bag having front and back walls and gussets at the sides, each gusset having front and back panels joined at a center fold, the front panel joining the front wall at a front fold and the back panel joining the back wall at a back fold, said folds extending longitudinally of the bag, one of said gussets having a line of weakness in each of a plurality of plies of the bag extending across it generally from the respective front fold across the center fold to the respective back fold adjacent one end of the bag, the lines of weakness being offset longitudinally of the bag and so located that, with respect to the bag as filled and closed, they are all spaced from said one end of the bag a distance somewhat greater than the gusset panel width, whereby, with respect to the bag as filled and closed, the portion of said one gusset between said lines of weakness and the said one end of the bag may be pushed in and separated from the remainder of said one side wall by tearing on said lines of weakness, and said portion may then be pulled outwardly and downwardly and folded on that part of the gusset center fold therein to form a pouring spout.

2. A bag as set forth in claim 1 wherein the front and back folds of said one gusset act as tear lines for tearing said portion away from the front and back walls generally to the said one end of the bag.

3. A bag comprising a plurality of plies of paper and having a front wall and a back wall and gussets at the sides, each gusset having front and back panels joined at a center fold, the front panel joining the front wall at a front fold and the back panel joining the back wall at a back fold, said bag having a closure at one end thereof, each of the paper plies having a line of perforations in one of the gussets extending generally straight across said gusset from the respective front fold across the center fold to the respective back fold generally at right angles thereto adjacent the end closure, the lines of weakness in adjacent plies being offset heightwise of the bag, and so located that, with respect to the bag as filled and closed, they are all spaced from said one end of the bag a distance somewhat greater than the gusset panel width, whereby with respect to the bag as filled and closed, the portion of said one gusset between the lines of perforations and the end closure may be pushed in and separated from the remainder of said one gusset one the lines of perforations, after which said portion may be pulled outwardly and downwardly and torn along the portions of the respective front and back folds from the ends of the lines of weakness toward said end closure to form a pouring spout with the side portions thereof folded up on that part of the gusset center fold therein.

* * * * *

UNITED STATES PATENT AND TRADEMARK OFFICE

CERTIFICATE OF CORRECTION

PATENT NO. : 4,768,654

DATED : September 6, 1988

INVENTOR(S) : Richard W. Jacobs

It is certified that error appears in the above—identified patent and that said Letters Patent is hereby corrected as shown below:

Column 4, claim 3, lines 55-56, "one gusset one the lines" should read --one gusset on the lines--.

Signed and Sealed this

Eighth Day of August, 1989

*Attest:*

DONALD J. QUIGG

*Attesting Officer*

*Commissioner of Patents and Trademarks*